United States Patent [19]

Tachibana et al.

[11] Patent Number: 4,898,801

[45] Date of Patent: Feb. 6, 1990

[54] MAGNETIC CARRIER OF DEVELOPER FOR ELECTROPHOTOGRAPHIC COPYING MACHINES COMPOSED OF FERRITE AND A SELECTED METAL OXIDE

[75] Inventors: Hidekiyo Tachibana; Akihiko Noda; Kazuo Terao, all of Kanagawa; Toshio Honjou, Chiba; Yukio Seki, Chiba; Hiroshi Endo, Chiba; Toshio Yokobari, Chiba, all of Japan

[73] Assignees: Fuji Xerox Co., Ltd., Tokyo; Nippon Iron Powder Co., Ltd., Chiba, both of Japan

[21] Appl. No.: 111,137

[22] Filed: Oct. 19, 1987

Related U.S. Application Data

[63] Continuation-in-part of Ser. No. 871,171, Jun. 3, 1986, abandoned, which is a continuation of Ser. No. 663,980, Oct. 23, 1984, abandoned.

[30] Foreign Application Priority Data

Oct. 24, 1983 [JP] Japan ..... 58-197500

[51] Int. Cl.[4] ..... G03G 9/10

[52] U.S. Cl. ..... 430/106.6; 430/108

[58] Field of Search ..... 430/106.6, 108, 111; 252/62.61, 62.64, 62.56

[56] References Cited

U.S. PATENT DOCUMENTS

| | | | |
|---|---|---|---|
| 3,740,335 | 6/1973 | Weaver | 252/62.61 |
| 3,918,968 | 11/1975 | Kukla et al. | 430/108 X |
| 4,147,834 | 4/1979 | Munzel et al. | 430/108 X |
| 4,248,954 | 2/1981 | Datta et al. | 430/108 X |
| 4,282,302 | 8/1981 | Makino et al. | 252/62.56 X |
| 4,457,955 | 7/1984 | Okamura et al. | 252/62.56 X |
| 4,485,162 | 11/1984 | Imamura et al. | 430/106.6 |
| 4,598,034 | 7/1986 | Honjo et al. | 430/106.6 |

FOREIGN PATENT DOCUMENTS

| | | | |
|---|---|---|---|
| 3118052 | 10/1978 | Japan | 430/106.6 |

*Primary Examiner*—John L. Goodrow

*Attorney, Agent, or Firm*—Finnegan, Henderson, Farabow, Garrett & Dunner

[57] ABSTRACT

A carrier of developers composed of a composition represented by $(MO)_X (Fe_2O_3)_Y$ having bulk density of 1.8–3.4 g/Cm$^3$ and magnetization of 10–30 emu/g in a magnetic field of 450–1000 Ö (oersted), where M is at least one metal selected from the group comprising lithium, manganese, nickel, zinc, cadmium, copper, cobalt, and magnesium.

5 Claims, 4 Drawing Sheets

MAGNETIC CARRIER OF DEVELOPER FOR ELECTROPHOTOGRAPHIC COPYING MACHINES COMPOSED OF FERRITE AND A SELECTED METAL OXIDE

This application is a continuation-in-part of application Ser. No. 871,171 filed June 3, 1986, now abandoned which is a continuation of application Ser. No. 663,980, filed Oct. 23, 1984, now abandoned.

BACKGROUND OF THE INVENTION

1. Field of the Invention

The present invention relates to a developer for electrophotographic copying machines, and more particularly to a carrier of two-component developer for electrophotographic copying machines.

2. Description of the Prior Art

Iron powder, ferrite powder, or the like have been used as carriers of two-component developers for electrophotographic copying machines. These carriers usually have a specific resistance of about $10^6\Omega$ cm, representing the conductive characteristic, and of about $10^{12}\Omega$ cm, representing the dielectric characteristic.

When using a conductive carrier having a specific resistance of about $10^6\Omega$ cm, an injection of an electric charge from a developing roll is effected and the actual developing electric field is enlarged, so that a solid black portion can be developed with high intensity. The term "solid black portion" means a solid black area of an original document to be copied. In these instances, however, there has sometimes occurred undesirable white lines within the solid black portion causing poor reproduction of a thin line.

On the other hand, when using a dielectric carrier having a specific resistance of about $10^{12}\Omega$ cm, the relationship between the developing electric field and the spatial frequency, i.e., number of lines/mm, is as shown in FIG. 1. The maximum value of the developing electric field is within the density region of 1.0 to 10 lines/mm, which means that the reproducibility of a thin line is excellent. The electric field for development becomes too weak, however, because the injection of the electric charge from the developing roll is not effected in the solid black portion and an electric charge with a polarity opposite to the polarity of the toner is retained on the carrier on the surface of the dielectric developer layer after development. A dielectric carrier, therefore, has the disadvantage of a so-called edge effect, whereby the toner density at the central portion of the solid black portion is reduced in comparison with that at the edge portion.

OBJECTS AND SUMMARY OF THE INVENTION

An object of the present invention is a carrier for a developer which maintains good reproducibility of a thin line particularly as obtained by a dielectric developer;

Another object of the present invention is a carrier for a developer which improves the toner density within the central area of a reproduction of a solid black area; and Yet another object of the present invention is a carrier for a developer which has a long, useful life.

These and other objects, features, and advantages are achieved by a carrier for a developer composed of a composition represented by $(MO)_Y(Fe_2O_3)_Y$ having bulk density of 1.8–3.4 g/cm$^3$ and magnetization of 10–30 emu/g in a magnetic field of 450–1000 Ö (oersted), where M is at least one metal selected from the group comprising lithium, manganese, nickel, zinc, cadmium, copper, cobalt, and magnesium.

BRIEF DESCRIPTION OF THE DRAWINGS

The manner in which the above and other objects, features and advantages of the present invention are achieved will be more clear from the following description with reference to the accompanying drawings, in which.

DETAILED DESCRIPTION OF THE PREFERRED EMBODIMENTS

The above-mentioned objects of the present invention are achieved by a carrier of developers composed of a composition represented by $(MO)_X(Fe_2O_3)_Y$ having bulk density of 1.8–3.4 g/cm$^3$, and magnetization of 10–30 emu/g when in a magnetic field of 450–1000 Ö (oersted). In this instance, M is at least one metal selected from the group comprising lithium, manganese, nickel, zinc, cadmium, copper, cobalt, and magnesium. The objects are also achieved by a carrier of developer composed of the above composition coated with resin.

Figure 1:
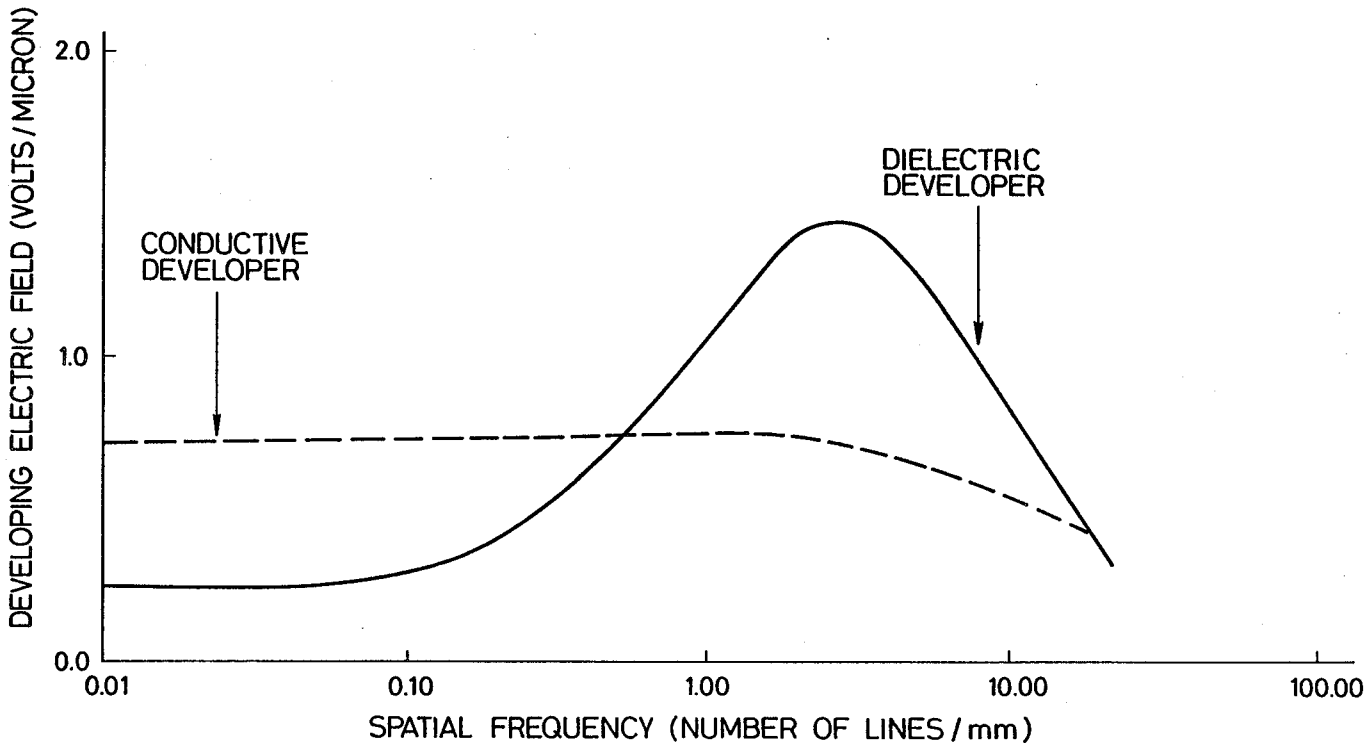
FIG. 1 is a graph showing the relationship between a developing electric field and a spatial frequency with respect to a conventional conductive carrier and a dielectric carrier of the present invention.
Figure 2:
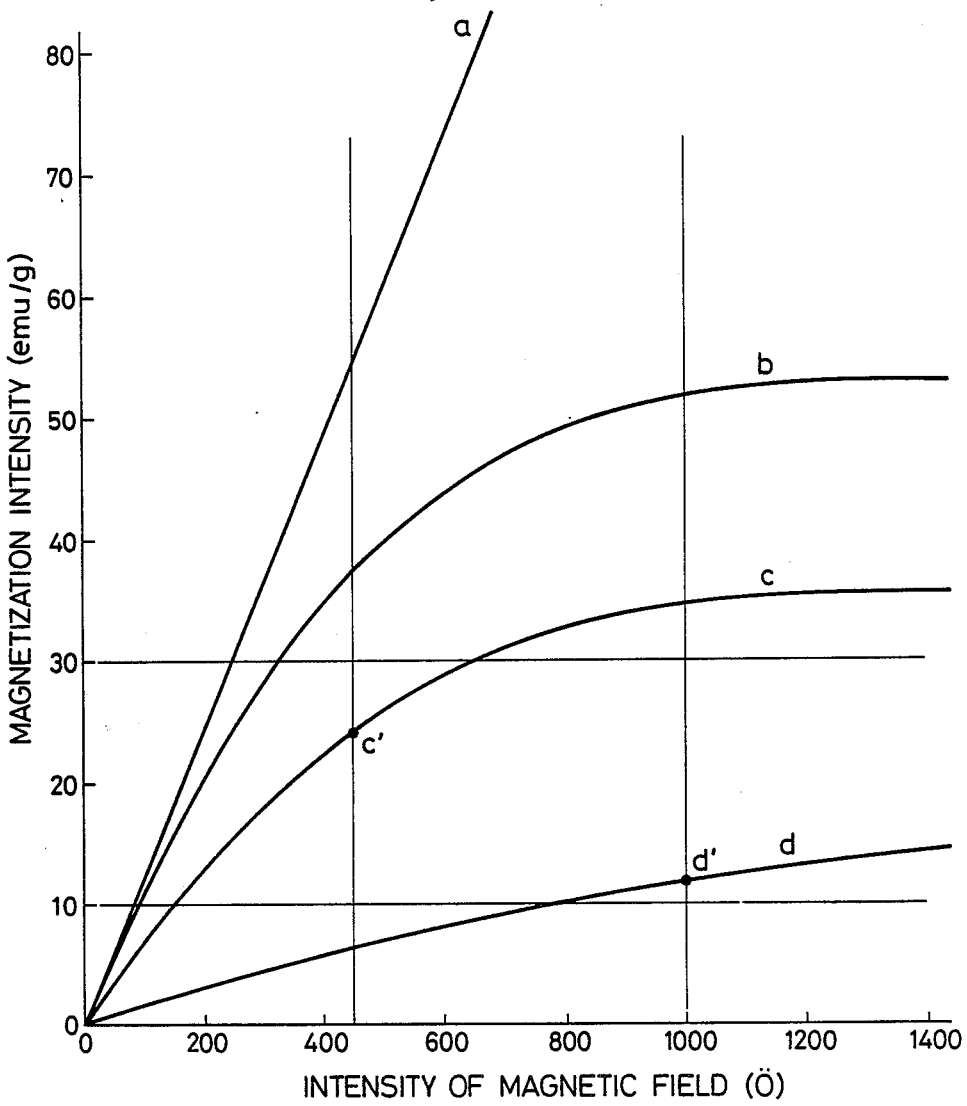
FIG. 2 is a graph showing the relationship between the intensity of a magnetic field and the magnetization intensity with respect to a conventional carrier and the carrier of the present invention.

Referring to FIGS. 2 to 5, an embodiment of the present invention is explained. FIG. 2 is a diagram showing the magnetization characteristics of a few types of carriers. In FIG. 2, the magnetization a denotes the characteristic of a conventional powder of iron oxide and b denotes the magnetization characteristic of a conventional ferrite carrier.

In the case of using powdered iron oxide having the magnetization characteristic as shown in the curve a of FIG. 2, the connecting force acting between the carriers is increased by the magnetic field on the developing roll so that only the toner on the surface of the developing layer serves the development. Also, a reverse electrical charge is, as mentioned hereinbefore, retained on the carrier on the surface of the developer layer causing the electric field for development to be weakened so as not to produce a copied image with high density. It may be possible to increase the density of the copied image by increasing the rotation speed of the developing roll. A toner image formed on a photosensitive body, however, is scraped by the carriers strongly connected with each other to produce deterioration of the quality of the copied image. The damage to the copied image normally takes the form of a white area in the copied image and of dotted lines extending in the direction perpendicular to the advance direction of the photosensitive body.

The reproducibility of a solid black portion in a copied image produced by a developing device using a magnetic brush was studied in connection with the present invention. In the developing device, the developer that was used comprised a toner mixed with a carrier that included ferrite as a main component. The reproducibility of such a solid black portion was also studied in conjunction with carriers having different magnetization characteristics. As a result it was found that good reproducibility of the solid black portion is obtained by the characteristics represented by the hatched region in FIG. 3 showing the relationship between the intensity of the magnetic field on the developing pole and the magnetization intensity of the carrier.

Figure 3:
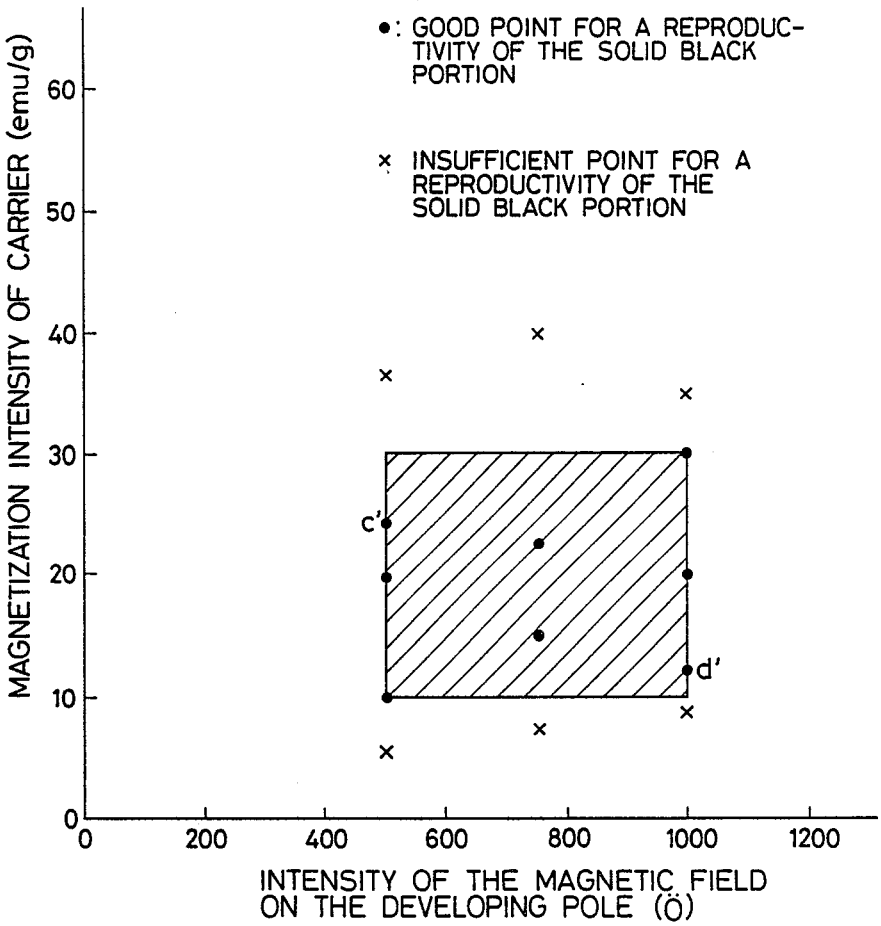
FIG. 3 is a graph showing a region of good reproducibility for a solid black portion.

The region in FIG. 3 is defined by the magnetic field having an intensity in the range of 450–1000 Ö and the magnetization having an intensity in the range of 10–30 emu/g. When the magnetization intensity of the carrier is below 10 emu/g, the amount of the carrier deposited on the photosensitive body increases resulting in insufficient toner density. The curves c and d of the magnetization characteristics of the carrier in FIG. 2 correspond to the points c' and d' in FIG. 3, respectively.

According to the carrier of the present invention having the magnetization characteristics as shown by the curves c and d in FIG. 2, the connecting force due to the magnetic field effected between the carriers is weakened so that movement of the developer on the development roll is easily made in the direction of thickness of the developing layer. The toner located within the inner portion of the developing layer may be used in the development. It is also possible to quickly remove the electric charge from the toner retained on the carrier on the surface of the developing layer, and to remove the toner together with the carrier, from the surface of the photosensitive body. As a result, a favorable copied image with high density can be obtained without weakening the developing electric field. The high density copied image also has uniform quality because the connection force acting between the carriers is not so strong as to cause the deterioration mentioned above.

Another advantage derived from the present invention using the carrier with the magnetization intensity 10–30 emu/g at the intensity of magnetic field of 450–1000 Ö, is to increase the life of the developer remarkably. It is known that the life of a two-component developer composed of toner and carrier is shortened by the fact that the toner, or an additive included in the toner, adheres to the surfaces of particles of the carrier thereby reducing the charging capacity of electric charge of the carrier. It is also known that the more the connecting force acting between the carriers due to the magnetic field is increased, the more additive that becomes attached to the surface, of the carrier.

Accordingly, with the carrier having a small connecting force acting between carriers, the adhesion of the toner or the additive to the surface of the carrier is remarkably reduced. The life of the developer is extended by an amount equal to about ten times the life of a conventional carrier powder composed of iron oxide.

The range of magnetization intensity of 10–30 emu/g in the magnetic field of 450–1000 Ö is realized by selecting the composition of the carrier. It is desirable to set the bulk density (A.D.) of the carrier in the range of 1.8 $g/cm^3$–3.4 $g/cm^3$, because if the carrier is made excessively porous, the mechanical strength of the carrier is undesirably reduced. Moreover, in the case of using the carrier coated with resin, it is difficult to coat the carrier with resin because the resin soaks through the porous carrier. On the other hand, if the bulk density is excessively large, the carrier is apt to fly and the developing machine must have an undesirably large torque.

As the mole ratio X/Y in the formula $(MO)_X(Fe_2O_3)_Y$ approaches 1 from 0.85, the magnetization is likely to become large. The mole ratio X/Y must be below 0.85 so that a magnetization intensity in the range of 10–30 emu/g can be maintained on the developing roll when the intensity of the magnetic field is in the range of 450–1000 Ö.

It is preferable for the carrier of the present invention to be composed of, in mole % (CuO) 0.15–0.4, (ZnO) 0–0.2, and ($Fe_2O_3$) 0.6–0.7. When the carrier is composed of cupric oxide, zinc oxide, and iron oxide within the specified ranges, the carrier may be sintered at a temperature lower than that of other metal oxides by about 200° C. Consequently, the carrier may be produced at substantially lower costs than conventional carriers comprised of these other metal oxides which require higher sintering temperatures. A predetermined value for the bulk density of the carrier is obtained by effecting the final heating process at about 1000° C. to eliminate bubbles in the carrier particles.

The carrier for a developer may also be composed of a composition represented by the formula $(CuO)_a(ZnO)_b(Fe_2O_3)_c$, where $a(mol)+b(mol)+c(mol)=1$, $0.17 \leqq a+b/c < 0.42$, and a is in the range from 0.1 to 0.3, b is in the range from 0.05 to 0.15, and c is in the range from 0.7 to 0.8. Such carrier compositions preferably have a bulk density of 1.8–3.4 $g/cm^3$ and a magnetization of 10–30 emu/g in a magnetic field of 450–500 Oe(oersted). The magnetic properties for several carriers having compositions within the above formula are set forth in the following table:

| CuO (mol %) | ZnO (mol %) | $Fe_2O_3$ (mol %) | Saturated Magnetization (emu/g) | Magnetization (emu/g) 450 Oe | Magnetization (emu/g) 500 Oe |
|---|---|---|---|---|---|
| 10 | 10 | 80 | 25 | 14 | 16 |
| 15 | 15 | 70 | 38 | 26 | 28 |
| 20 | 10 | 70 | 38 | 27 | 29 |
| 25 | 5 | 70 | 36 | 24 | 27 |
| 30 | 0 | 70 | 19 | 10 | 13 |

Carriers having a composition within the above formula, such as the first four compositions in the table above, can be sintered at a temperature about 200° C. lower than the sintering temperature for carriers composed of other metal oxides and, therefore, can be produced at lower cost than such carriers composed of other metal oxides.

The carrier is made by combining the (MO) with the ($Fe_2O_3$) such that the mole ratio X/Y is below 0.85. The mixture is then ground and mixed for more than one hour by using a wet-type ball mill or a wet-type vibration ball mill. The slurry thus obtained is dried, further ground and then calcined at a temperature of 700–1200° C. The calcined product is further ground to prepare fine particles having sizes of less than 20 μm, and preferably less than 5 μm, and is then granulated.

The granules thus prepared are kept at a temperature of 1000–1500° C. for 1–24 hours. The sintered product may be further reduced and the surface thereof may be re-oxidized at a lower temperature, if necessary. A desirable specific resistance of the carrier can be obtained by coating the carrier with a styrene resin, a fluoro resin, or the like. In this case, the resin used for the coating is selected in accordance with the toner used.

The above-mentioned manufacturing method produces an ideal carrier for a developer. The above-mentioned manufacturing method is, however, merely an example and, therefore, the present invention is not limited to this manufacturing method.

Referring now to a specific example of the carrier of the present invention, the carrier is obtained as follows.

EXAMPLE

CuO 0.23 mol %, ZnO 0.07 mol %, and $Fe_2O_3$ 0.7 mol % were ground and mixed for ten hours by using a wet-type ball mill, and then dried and calcined at a temperature of 900° C. for four hours. The product was further ground by using the wet-type ball mill to form particles with sizes of less than 5 μm. The slurry thus obtained was formed in particle size, dried, and then meshed in a mesh of 80–180. The surface of the resultant carrier was coated with a styrene resin.

Figure 4:
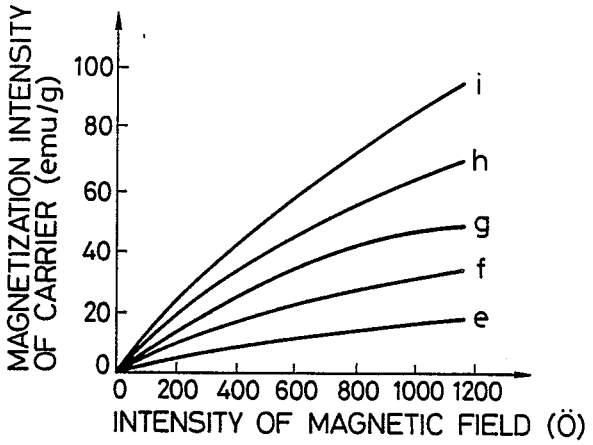
FIG. 4 is a graph showing the magnetization characteristics of a carrier of the present invention and another carrier.

The carrier has a magnetization characteristic as shown by curve f in FIG. 4, and the magnetization intensity is 33 emu/g when the intensity of the magnetic field is 1000 Ö. The magnetization intensity is 20 emu/g when the intensity of the magnetic field is 500 Ö. The bulk density of the carrier is 2.4 g/cm$^3$.

According to a copy test using the two-component developer composed of the toner and the carrier, and a conventional magnetic brush developing device, an original image having a solid black portion with a gray density of 0.7 was copied with image density of 1.1 even in the central portion of the solid black portion.

Several carriers having different magnetization characteristic curves as shown in FIG. 4 were similarly tested. The curves e and g denote the magnetization characteristics of carriers having the magnetization intensity of 10 emu/g and 30 emu/g, respectively, in a magnetic field of 500 Ö. The curves h and i denote a magnetic intensity of 40 emu/g and 50 emu/g, respectively, in a similar magnetic field.

Figure 5:
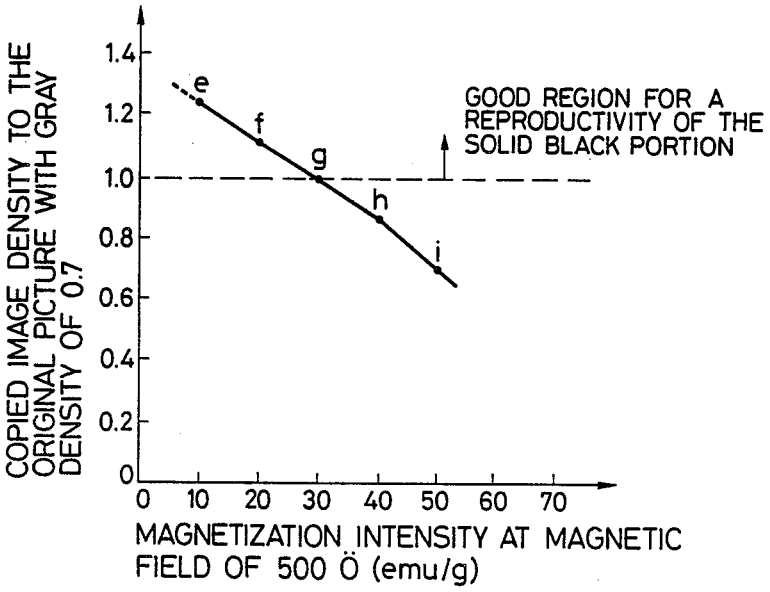
FIG. 5 is a graph showing the reproducibility of a solid black portion for carriers having the magnetization characteristics shown in FIG. 4.

As a result of the test, the carriers shown in the curves e and g obtained good reproducibility for solid black portions as shown in FIG. 5. The carriers shown in the curves h and i obtained an insufficient reproducibility at the points h and i. The dotted line in FIG. 5 denotes a boundary line for conditions producing good reproducibility for a solid black portion from conditions producing poor reproducibility.

A continuous copying test was conducted to compare the life of the carrier of the present invention to conventional carriers. The life of the conventional carrier with iron oxide was approximately 20,000 copies per 1 Kg unit of toner. On the other hand, the carrier of the present invention gave satisfactory performance through approximately 250,000 copies per 1 Kg unit of toner.

As mentioned above, the reproducibility of thin lines, which are inherently provided on the dielectric developer, can be maintained at a high level with the developer of the present invention. Moreover, the toner density of solid black areas is increased and the useful life of the developer is remarkably improved when compared to prior art developers.

Although a preferred embodiment of the invention has been described, it should be understood that the preferred embodiment of the present invention, as described herein, may be changed or modified without departing from the spirit and the scope of the invention as hereinafter claimed.

What is claimed is:

1. A carrier for a developer composed of a composition represented by the formula $(CuO)_a(ZnO)_b(Fe_2O_3)_c$, wherein $a(mol)+b(mol)+c(mol)=1$, $0.17 \leqq a+b/c < 0.42$, a is in the range from 0.1 to 0.3, b in the range from 0.05 to 0.15, and c in the range from 0.7 to 0.8, said composition having a bulk density of 1.8–3.4 g/cm$^3$ and a magnetization of 10–30 emu/g in a magnetic field of 450–500 Oe(oerested).

2. The carrier for a developer according to claim 1, wherein said carrier is comprised of particles having said composition coated with a resin.

3. The carrier for a developer according to claim 2, wherein said resin is styrene resin.

4. The carrier for a developer according to claim 3, wherein said resin is fluoro resin.

5. A developer comprising a mixture of a toner and a carrier for said toner, said carrier composed of a composition represented by the formula $(CuO)_a(ZnO)_b(Fe_2O_3)_c$, wherein $a(mol)+b(mol)+c(mol)=1$, $0.17 \leqq a+b/c < 0.42$, and a is in the range from 0.1 to 0.3, b in the range from 0.05 to 0.15, and c in the range from 0.7 to 0.8, said composition having a bulk density of 1.8–3.4 g/cm$^3$ and a magnetization of 10–30 emu/g in a magnetic field of 450–500 Oe(oersted).

* * * * *